US008814384B2

(12) United States Patent
Teklak

(10) Patent No.: US 8,814,384 B2
(45) Date of Patent: Aug. 26, 2014

(54) LIGHT HAVING LED MODULES

(75) Inventor: Janusz Teklak, Traunstein (DE)

(73) Assignee: Siteco Beleuchtungstechnik GmbH, Traunreut (DE)

( * ) Notice: Subject to any disclaimer, the term of this patent is extended or adjusted under 35 U.S.C. 154(b) by 0 days.

(21) Appl. No.: 13/638,691

(22) PCT Filed: Mar. 23, 2011

(86) PCT No.: PCT/EP2011/001452
§ 371 (c)(1),
(2), (4) Date: Dec. 12, 2012

(87) PCT Pub. No.: WO2011/120652
PCT Pub. Date: Oct. 6, 2011

(65) Prior Publication Data

US 2013/0229803 A1 Sep. 5, 2013

(30) Foreign Application Priority Data

Apr. 1, 2010 (DE) ..... 10 2010 013 678
May 25, 2010 (DE) ..... 10 2010 021 452

(51) Int. Cl.
*F21V 7/04* (2006.01)

(52) U.S. Cl.
CPC ..... *F21V 7/04* (2013.01)
USPC ..... 362/243; 362/241

(58) Field of Classification Search
None
See application file for complete search history.

(56) References Cited

U.S. PATENT DOCUMENTS

| | | | | |
|---|---|---|---|---|
| 7,766,508 | B2 * | 8/2010 | Villard et al. | 362/249.02 |
| 7,942,559 | B2 * | 5/2011 | Holder et al. | 362/311.06 |
| 2005/0094393 | A1 | 5/2005 | Czajkowski | |
| 2008/0062689 | A1 | 3/2008 | Villard | |
| 2009/0296388 | A1 | 12/2009 | Wu et al. | |
| 2010/0284169 | A1 * | 11/2010 | Bertram et al. | 362/97.1 |
| 2010/0296266 | A1 * | 11/2010 | Dussault et al. | 362/84 |
| 2011/0110083 | A1 * | 5/2011 | Pahlke et al. | 362/245 |

FOREIGN PATENT DOCUMENTS

| | | |
|---|---|---|
| CN | 101059213 | 10/2007 |
| CN | 201103817 | 8/2008 |
| CN | 201228918 | 4/2009 |
| CN | 101446404 | 6/2009 |
| CN | 101675293 | 3/2010 |
| DE | 10 2008 007 7 | 8/2009 |
| DE | 10 2008 007 723 | 8/2009 |
| WO | WO 2006/060905 | 6/2006 |
| WO | WO 2008/122941 | 4/2008 |
| WO | WO 2009/110976 | 9/2009 |
| WO | WO 2010/028509 | 3/2010 |

* cited by examiner

*Primary Examiner* — Mary Ellen Bowman
(74) *Attorney, Agent, or Firm* — Cozen O'Connor

(57) ABSTRACT

A luminaire, in particular an outdoor luminaire, comprising a luminous means mount surface (10) on which a plurality of LED modules (20) are arranged, wherein the LED modules (20) respectively have a matrix of a plurality of LEDs (22), which are arranged in a plane (24), and a reflector strip (26), which adjoins on one edge of the plane (24) and is angled with respect to the plane (24), wherein the LEDs (22) each have an integrated optical unit which, in a cross section through the LED (22) perpendicular to the plane (24), creates two maxima of the luminous intensity distribution of the respectively individual LED (22), which maxima are deflected laterally with respect to the surface normal (28) of the plane (24) through the LED (22), wherein the light radiation from the LED (22) is reflected by the reflector strip (26) in one of the two maxima.

19 Claims, 4 Drawing Sheets

LIGHT HAVING LED MODULES

RELATED APPLICATIONS

This is a U.S. National Phase Application under 35 USC 371 of International Application PCT/EP2011/001452 filed on Mar. 23, 2011.

This application claims the priority of German application no. 10 2010 013 678.6 filed Apr. 1, 2010 and 10 2010 021 452.3 filed May 25, 2010, the entire contents of both of which are hereby incorporated herein by reference.

FIELD OF THE INVENTION

The invention relates to luminaires, in particular street or path luminaires for outdoors, having a plurality of LED modules.

BACKGROUND OF THE INVENTION

Advances in the technical development of LEDs as light sources, in particular the development of particularly powerful LEDs, have made it possible to use such light sources as luminous means for outdoor luminaires, in particular street luminaires. Here, provision is to be made for a multiplicity of LEDS which, in order to obtain a wanted light distribution, have to be arranged within the luminaire and optionally be provided with reflectors.

A street luminaire comprising LEDs as luminous means has been disclosed in the document WO 2006/060905 A1. The LEDs are arranged in a plurality of partial planes, which can be adjusted with respect to one another in order to be able to create different light distributions.

However, the options for creating wanted light distributions using the designs known from the prior art are greatly restricted. In order to create wanted light distributions, other developments provide very complicated reflector structures on the LED modules.

SUMMARY OF THE INVENTION

The object of the present invention is to provide an LED luminaire with a modular design, in particular for the outdoors, which, using LED modules with simple designs, enables the creation of light distributions which are particularly suitable for street and path luminaires.

This and other objects are attained in accordance with one aspect of the invention directed to a luminaire, in particular an outdoor luminaire, comprising a luminous means mount surface on which a plurality of LED modules are arranged, wherein the LED modules respectively have a matrix of a plurality of LEDs ("light-emitting diodes", which should be understood also to include "organic light-emitting diodes (OLEDs)), which are arranged in a plane, and a reflector strip, which adjoins on one edge of the plane and is angled with respect to the plane, wherein the LEDs each have an integrated optical unit which, in a cross section through the LED perpendicular to the plane, creates two maxima of the luminous intensity distribution of the respectively individual LED, which maxima are deflected laterally with respect to the surface normal of the plane through the LED, wherein the light radiation from the LED is reflected by the reflector strip in one of the two maxima.

The luminaire according to an embodiment of the invention comprises a luminous means mount surface, on which LED modules with a comparatively simple design can be arranged. The LEDs on the modules have an integrated optical unit, which, in a vertical cross section through the LED, creates two maxima in the luminous intensity distribution. Such LEDs with optical units are also known as "side-emitting LEDs". However, these LEDs are disadvantageous for the application in street luminaires because they in each case create a completely symmetrical light distribution, and so even the combination of a plurality of such LEDs does not allow the formation of asymmetric light distribution curves, as required for illuminating paths or streets. Side-emitting LEDs with a slightly oval light distribution are also known, i.e. the two maxima of the light distribution are pronounced to a different extent in two cross sections (along a major diameter and a minor diameter of the oval). However, this asymmetry is also insufficient for being able to create every wanted overall light distribution of the luminaire by arranging the LEDs. The solution according to the invention provides for modules which have a reflector strip arranged laterally with respect to an LED matrix in a plane, said reflector strip asymmetrically deforming the emission characteristic of the individual modules. As a result of the asymmetrically emitting LED modules and the option of freely arranging the LED modules on a luminous means mount surface within the luminaire, it is possible to create a large variety of suitable overall light distributions. Here there should be particular emphasis on the fact that the LED modules have a simple design. The invention does not require complicated reflector structures.

According to a preferred embodiment, the integrated optical unit ensures a deflection of the maxima of the luminous intensity distribution curve of the individual LED of at least 10°, preferably of at least 20° or 30°, with respect to the surface normal of the plane through the LED in the cross section passing perpendicularly through the LED. This lateral deflection with respect to the surface normal, in conjunction with the laterally arranged reflector strip, is already sufficient for providing an LED module which has significant asymmetry in its light emission, and so it is possible to obtain a wanted (asymmetric) overall light distribution of the luminaire by arranging the LED modules.

According to a preferred embodiment, the individual LEDs with an integrated optical unit have an oval or circular emission characteristic with respect to the surface normal of the plane through the LEDs. This emission characteristic can be created directly at the LED by means of a comparatively simple optical unit. The oval emission characteristic is moreover advantageous in that the LEDs can be arranged with the longer axis of the oval being perpendicular to the reflector strip. As a result of this, a maximum, which has a larger deflection angle with respect to the surface normal through the LEDs on the plane, is directed so as to be reflected at the reflector strip, resulting overall in a greater asymmetry of the light distribution of the individual module. However, in order to equalize the light distribution of respectively one LED module, it may also be preferable to arrange the LEDs with an oval light distribution such that the major axis of the oval has an angle of between ±5° with respect to the cross-sectional plane perpendicular to the reflector strip. As a result of this it is possible to equalize the light distribution created by an LED module a little.

According to a preferred embodiment, in the LED modules, the reflector strips include an angle with the plane in which the LED matrix is arranged of between 65° and 115°, preferably of between 80° and 100°, particularly preferably of approximately 90°. An approximately right-angled arrangement of the reflector strip with respect to the plane of the LED matrix is advantageous in that the light distribution of an LED, which, in a cross section perpendicular to the plane and perpendicular to the reflector strip, has two maxima tilted by ±γ with respect to the surface normal, is deflected onto one side after the reflection at the reflector strip. If the reflector strip is arranged at 90° with respect to the plane of the LED matrix, then the maximum of the luminous intensity distribution curve pointing in the direction of the reflector strip is, after reflection at the reflection strip, emitted in the same direction (but with a parallel offset) as the symmetric maximum on the opposite side of the LED. As a result, the two maxima of the light distribution superpose and create a particularly pronounced asymmetric light distribution.

According to a preferred embodiment, the planes of the LED modules form an angle that differs from 0°, preferably an angle of between ±5° and ±40°, with respect to the luminous means mount surface. This tilt can used be to align the LED modules differently with respect to one another, for example in various rows or columns, in order thereby to obtain a wanted overall light distribution of the luminaire.

According to a preferred embodiment, the LED modules are arranged in parallel within rows on the luminous means mount surface. Such a row on the luminous means mount surface creates a maximum of the overall luminous intensity distribution of the luminaire in the direction perpendicular to the longitudinal extent of the row. In particular, it is possible to arrange two such rows of LED modules in a mirror-symmetric fashion, as a result of which an overall luminous intensity distribution is created which has two opposing symmetric maxima. Such a light distribution is suitable for illuminating an area extending in the longitudinal direction, such as e.g. a section of a path or a section of a street over which the luminaire is arranged.

According to a preferred embodiment, at least some of the LED modules are arranged such that the edges at which the reflector strips adjoin the plane are not aligned parallel to one another. As a result of this arrangement of LED modules it is possible to create a light distribution characteristic which has a light-band deflection that deviates from 0°. A light-band deflection should be understood to mean that two maxima of the light distribution do not run along a common axis in a horizontal section through the luminaire, but rather include an angle differing from 180°, e.g. an angle between 140° or 170°, between one another. Such a light distribution is particularly suitable for illuminating a street using a luminaire arranged laterally next to the street.

According to a preferred embodiment, the spacing of the LEDs in the planes of the modules is at least 20 mm, preferably between 25 mm and 50 mm. Dropping below a spacing of 20 mm leads to thermal problems because the high-power LEDs used for outdoor luminaire use emit significant amounts of heat. In order to cool the LEDs, the plane of the LED modules can furthermore be arranged on a plate of thermally conductive material, e.g. on an aluminum body. However, if the spacing between the LEDs is greater than 50 mm, there is a fall in the luminance that can be produced by the module. In this case, the modules for obtaining a predetermined overall luminous intensity would be too large to be able to be used as outdoor luminaires in a meaningful way.

A further aspect of the invention relates to the individual LED module, as described above. These modules can be produced and distributed as individual parts in order to be able to be used as replacement element for luminaires of the aforementioned embodiments.

BRIEF DESCRIPTION OF THE DRAWINGS

Further features and advantages of the present invention will, on the basis of preferred embodiments, be described below in conjunction with the attached figures. The figures illustrate the following.

DETAILED DESCRIPTION OF THE DRAWINGS

With respect to FIGS. 1 to 4, various embodiments of LED outdoor luminaires are illustrated, with, for reasons of simplicity, the housing and possibly present covers, e.g. light-scattering plates or troughs, of the lights and further mechanical, and electric accessories not being illustrated. The cover can be a clear or light-scattering cover disk, which is preferably planar. Provision can furthermore be made for an antireflection coating to be on the cover disk. The antireflection coating can also be embodied such that it itself ensures the light scattering.

The embodiments of the luminaire comprise a luminous means mount surface 10, which, according to the illustrated embodiments, is planar. A number of LED modules 20 are arranged on the mount surface 10.

Figure 5:
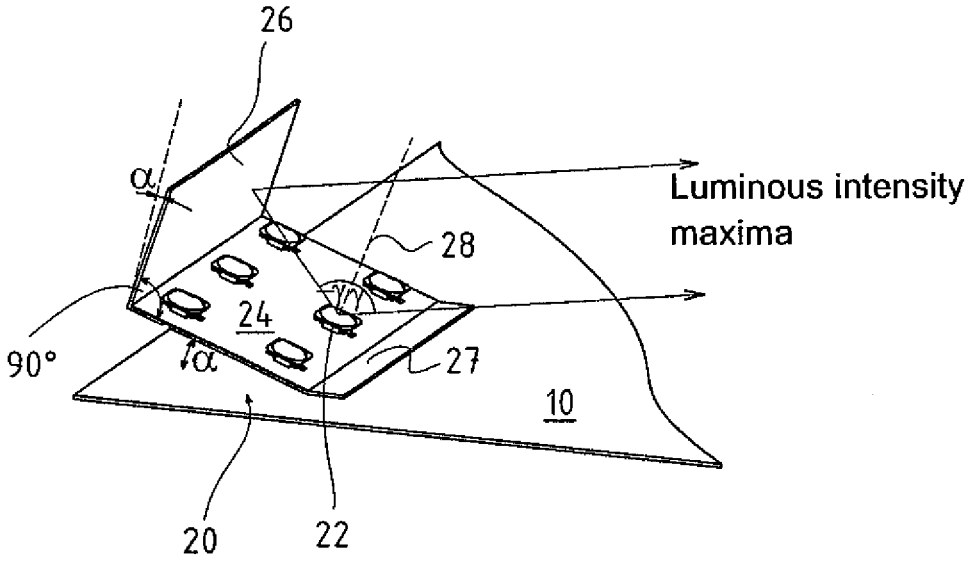
FIG. 5 shows a section of a luminaire according to one of the embodiments according to FIGS. 1 to 4, with only one LED module being illustrated.

In order to explain the shape and function of an LED module 20, reference is made to FIG. 5. The LED module 20 has a plane 24, which, for example, is formed by a contiguous circuit board. A metal plate, preferably of aluminum, is preferably arranged below the circuit board (not illustrated in the figures) in order to serve as stable mount and in order to ensure heat dissipation.

A matrix of LEDs 22 is arranged on the plane 24. In the figures, the LEDs are arranged on a rectangular matrix. However, a matrix should also be understood as meaning a different regular arrangement of LEDs. In particular, the LEDs in different rows or columns of the matrix can be arranged offset with respect to one another.

The LED module furthermore has a lateral reflector strip 26, which adjoins at right angles to an edge of the plane 24. On the side facing the LEDs, the reflector strip 26 has a high gloss reflective or matt reflective configuration. An attachment strip 27, which has an angle α, preferably between 5° and 40°, with respect to the plane 24, is arranged on the opposite edge of the plane 24. The attachment strip 27 is attached to the luminous means mount surface 10 in a flat fashion such that the plane 24 is tilted by the angle α with respect to the luminous means mount surface 10.

Each LED 22 has an integrated optical unit (not visible in the figures) which ensures that, in a cross section perpendicular to the plane 24, each LED has at least two maxima in the light distribution, which maxima are tilted with respect to the surface normal 28 through the LED and on the plane 24. In order to clarify these circumstances, reference is made to FIGS. 6 and 7, which show measurements of luminous intensity of the LED modules without reflector strips 26. FIG. 7 shows a polar plot of the luminous intensity distribution of the LED matrix in three different vertical sectional planes through the LED matrix. It is possible to identify that two symmetric maxima are respectively formed in all three sectional planes. The most pronounced maxima lie in the 0°-180°-plane at approximately ±55°. In the plane perpendicular thereto, i.e. in the plane 90°-270°, the maxima are less pronounced and are at approximately ±35°.

Figure 6:
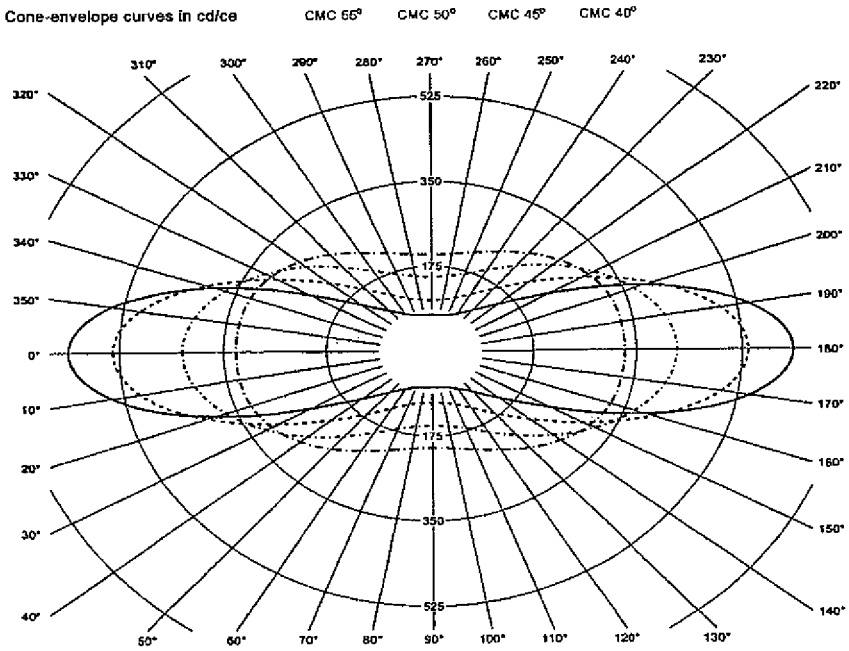
FIG. 6 shows the luminous intensity measured in four cone-envelope curves of an LED matrix of an LED module without reflector strips.
Figure 7:
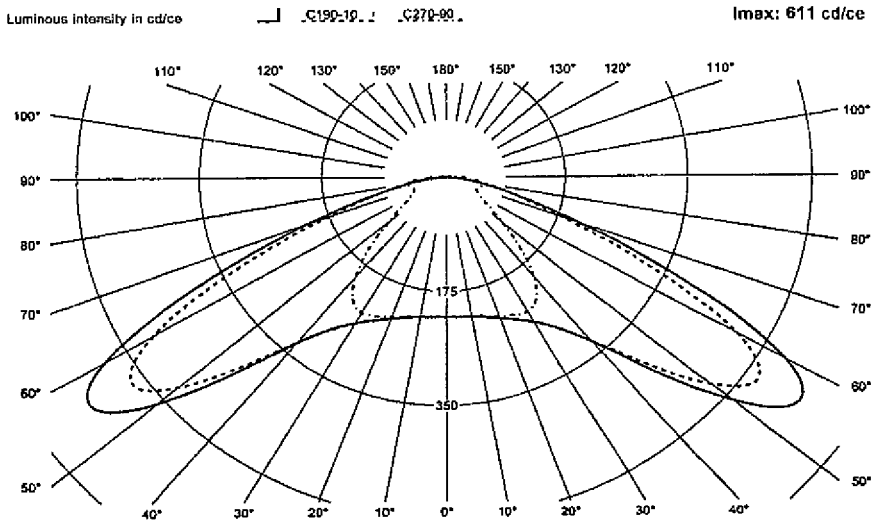
FIG. 7 shows a luminous intensity distribution curve in three different vertical planes through a matrix of LEDs of an LED module without lateral reflector strip.

In the illustration according to FIG. 6, the luminous intensity is plotted in a cone-envelope curve, i.e. what is shown is a measurement of the luminous intensity along the edge of a cone envelope around the surface normal 28 of the LED matrix. In the case of an LED emitting in a circular-symmetric fashion, one would only see circles in this illustration. However, the LEDs of the illustrated embodiment have an oval luminous intensity distribution. According to this, the luminous intensity in the cone-envelope curves has an oval distortion or even has a constriction along the shorter axis.

The LEDs 22 or the integrated optical units are arranged in the LED module such that the extended maxima (i.e. the maxima at ±55° in the 0°-180°-plane as per FIG. 7 or at the 0°-180°-axis in FIG. 6) are aligned in the direction perpendicular to the reflector strip 26. In FIG. 5, the directions of the maxima are illustrated by two light beams. Corresponding to the position of the maxima in FIG. 7, these light beams have a deflection of ±γ with respect to the surface normal 28 through the LED 22. The right-hand one of the two maxima leaves the LED module at an angle γ with respect to the surface normal 28 without reflection. The left-hand one of the two maxima is emitted in the direction of the reflector strip 26 and reflected once at the latter. As a result of arranging the reflector strip 26 at 90° with respect to the plane 24, the reflection is brought about in a direction which has a parallel offset with respect to the direction of the opposing maxima which leaves the LED directly at an angle γ. Accordingly, the two maxima of the luminous intensity distribution superpose in the overall light distribution of the LED module. The parallel offset of the two illustrated light beams, which indicate the direction of the maxima, plays no further role when the distance of the areas to be illuminated from the luminaire is considered.

The LED modules 22 accordingly create a very asymmetric light distribution, which leaves the LED module at an angle of γ+α with respect to the normal of the luminous means mount surface 10.

Using these modules 22, it is possible to design various embodiments of outdoor luminaires, which are illustrated in FIGS. 1 to 4 in an exemplary fashion. In order to create an overall light distribution which should have two symmetric maxima on both sides, the LED modules 22 can be arranged in two rows, within which the LED modules are respectively arranged parallel to one another, and the two rows are arranged mirror symmetrically with respect to one another. In the process, it is possible for the backs of the reflector strips 26 to be opposite to one another (see FIG. 1) or for the LED modules to be able to be arranged with the reflecting sides of the reflector strips 26 pointing at the LEDs facing one another (see FIG. 2). Both embodiments create approximately the same light distribution. These luminaires are particularly suitable as a path or street luminaire which is arranged above the path or street section to be illuminated because the created overall light distribution can uniformly illuminate an elongate area, i.e. parallel to the street or to the path.

Figure 1:
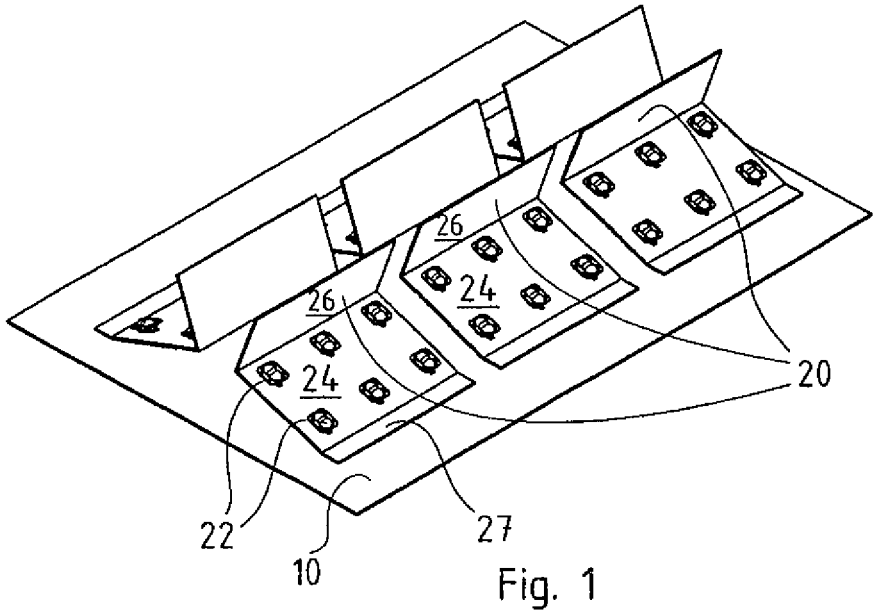
FIGS. 1 to 4 show various embodiments of the luminaires according to the invention, wherein housing and cover elements have been omitted for reasons of simplicity.
Figure 2:
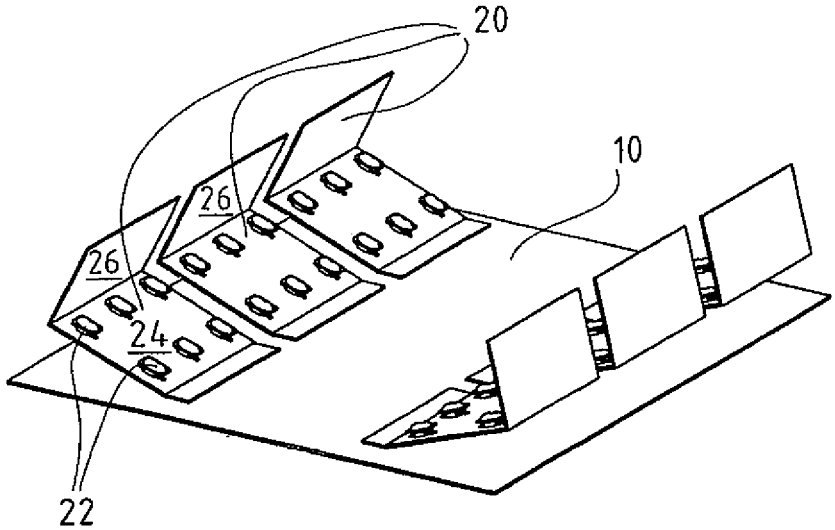
Figure 3:
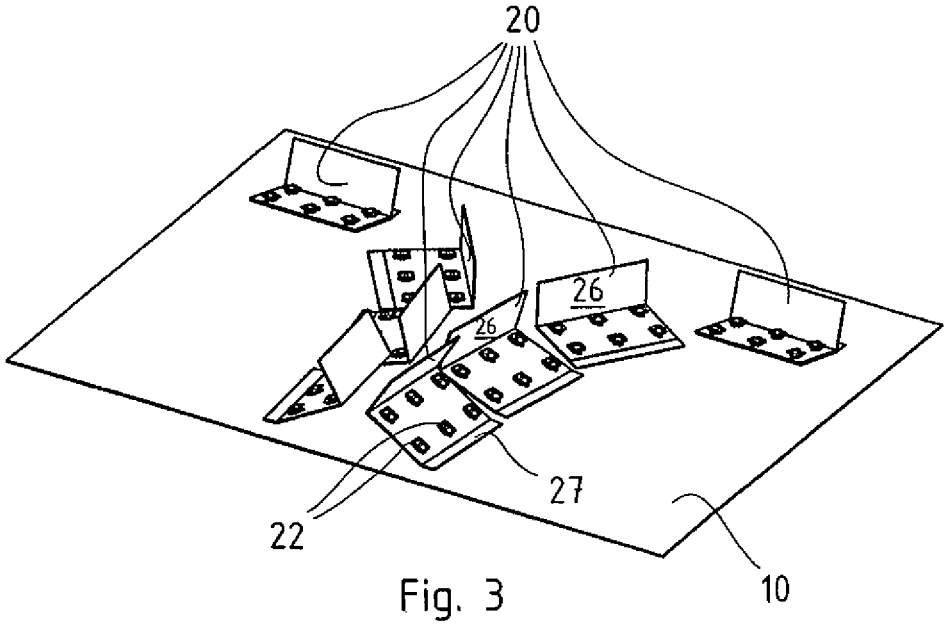
Figure 4:
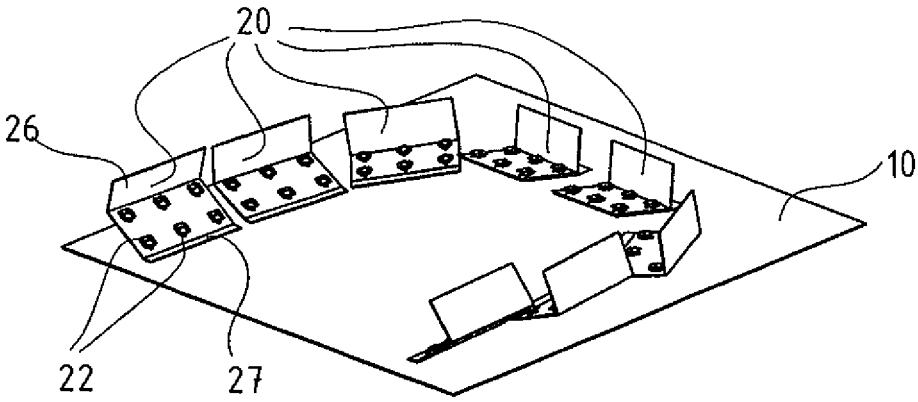

FIGS. 3 and 4 show alternative embodiments, which are designed to create a light-band deflection. This should be understood as meaning that the overall light distribution of the produced luminaire does not have two maxima arranged opposing one another by 180° (as in FIG. 6) but rather that the maxima are tilted with respect to an axis (corresponding to the 0°-180°-axis in FIG. 6). Such luminaires are particularly suitable for illuminating streets by luminaires which are arranged laterally next to the street. The light-band deflection is created by reflector modules, the longitudinal edges of which, i.e. the edge between the plane 24 and the reflector strip 26, run along a curved curve. Accordingly, the respectively front six LED modules 22 in FIGS. 3 and 4 in particular bring about the light-band deflection. The two rear LED modules predominantly illuminate the area under the luminaire.

Further modifications of the embodiments described above are possible within the scope of the invention, which is defined by the claims. In particular, the invention provides for it to be possible to arrange the LED modules in any fashion on the luminous means mount surface in order to create wanted light distributions. By way of example, the LED modules could also be arranged in a circular fashion in order to form a street luminaire which illuminates a round area or a roundabout from the center. Other forms are likewise possible.

The invention claimed is:

1. A luminaire, comprising:

a luminous means mount surface; and a plurality of LED modules arranged on the luminous means mount surface;

wherein each LED of the plurality of LED modules respectively has a matrix of a plurality of LEDs, which are arranged in a plane, and one single reflector strip, which adjoins on one edge of the plane and is angled with respect to the plane;

wherein the plurality of LEDs each have an integrated optical unit which, in a cross section through an LED perpendicular to the plane, creates two maxima of a luminous intensity distribution of a respective individual LED, which two maxima are deflected laterally with respect to a surface normal of the plane through the individual LED; and wherein light radiation from the individual LED is reflected by the single reflector strip in only one of the two maxima.

2. The luminaire as claimed in claim 1, wherein the integrated optical unit ensures a deflection of a maxima of a luminous intensity distribution curve of the respectively individual LEDs at said cross section by an angle γ of at least ±10° with respect to the surface normal.

3. The luminaire as claimed in claim 1, wherein the individual LEDs with the integrated optical unit have an oval or circular emission characteristic with respect to the surface normal of the plane through the LED.

4. The luminaire as claimed in claim 1, wherein, in the LED modules, the reflector strips form an angle of 65° to 115° with respect to the plane.

5. The luminaire as claimed in claim 1, wherein planes of the plurality of LED modules form an angle α that differs from 0° with respect to the luminous means mount surface.

6. The luminaire as claimed in claim 1, wherein the plurality of LED modules within at least one row on the luminous means mount surface are arranged parallel to one another.

7. The luminaire as claimed in claim 6, wherein at least two rows of the plurality of LED modules are arranged mirror symmetrically.

8. The luminaire as claimed in claim 1, wherein at least some of the plurality of LED modules are arranged such that edges at which the reflector strips adjoin the plane are not aligned parallel to one another.

9. The luminaire as claimed in claim 1, wherein the spacing of the LEDs in the matrix from the next adjacent LED is at least 20 mm.

10. An LED module for assembly on the luminous means mount surface of the luminaire as claimed in claim 1, wherein the LED module respectively has the matrix of the plurality of LEDs, which are arranged in the plane, and respectively has one single reflector strip, which adjoins on one edge of the plane and is angled with respect to the plane, wherein the plurality of LEDs each have the integrated optical unit which, in the cross section perpendicular to the plane, creates two maxima of the luminous intensity distribution of the respective individual LED, which two maxima are deflected laterally with respect to the surface normal of the plane through the individual LED, and the light radiation from the individual LED is reflected by the single reflector strip in only one of the two maxima.

11. The luminaire as claimed in claim 1, wherein, in the LED modules, the reflector strips form an angle of between 85° and 95° with respect to the plane.

12. The luminaire as claimed in claim 1, wherein planes of the LED modules form an angle $\alpha$ between 5° and 40° with respect to the luminous means mount surface.

13. The luminaire as claimed in claim 1, wherein planes of the LED modules form an angle $\alpha$ between −5° and −40° with respect to the luminous means mount surface.

14. The luminaire as claimed in claim 1, wherein spacing of the LEDs in the matrix from a next adjacent LED is between 25 mm and 50 mm.

15. The luminaire as claimed in claim 1, wherein the integrated optical unit ensures a deflection of a maxima of a luminous intensity distribution curve of the respectively individual LEDs at said cross section by an angle $\gamma$ of at least ±20° with respect to the surface normal.

16. The luminaire as claimed in claim 1, wherein the integrated optical unit ensures a deflection of a maxima of a luminous intensity distribution curve of the respectively individual LEDs at said cross section by an angle $\gamma$ of at least ±30° with respect to the surface normal.

17. The luminaire as claimed in claim 1, wherein the luminaire is an outdoor luminaire.

18. A luminaire comprising:

a luminous means mount surface; and a plurality of LED modules arranged on the luminous means mount surface;

wherein each LED of the plurality of LED modules respectively has a matrix of a plurality of LEDs, which are arranged in a plane, and a reflector strip, which adjoins on one edge of the plane and is angled with respect to the plane;

wherein the plurality of LEDs each have an integrated optical unit which, in a cross section through an LED perpendicular to the plane, creates two maxima of a luminous intensity distribution of a respective individual LED, which two maxima are deflected laterally with respect to a surface normal of the plane through the individual LED;

wherein light radiation from the individual LED is reflected by the reflector strip in one of the two maxima; and wherein planes of the plurality of LED modules form an angle $\alpha$ that differs from 0° with respect to the luminous means mount surface.

19. A luminaire, comprising:

a luminous means mount surface; and a plurality of LED modules arranged on the luminous means mount surface;

wherein each LED of the plurality of LED modules respectively has a matrix of a plurality of LEDs, which are arranged in a plane, and a reflector strip, which adjoins on one edge of the plane and is angled with respect to the plane;

wherein the plurality of LEDs each have an integrated optical unit which, in a cross section through an LED perpendicular to the plane, creates two maxima of a luminous intensity distribution of a respective individual LED, which two maxima are deflected laterally with respect to a surface normal of the plane through the individual LED;

wherein light radiation from the individual LED is reflected by the reflector strip in one of the two maxima; and wherein at least some of the plurality of LED modules are arranged such that edges at which reflector strips adjoin the plane are not aligned parallel to one another.

* * * * *